US011325182B2

(12) United States Patent
Bales et al.

(10) Patent No.: US 11,325,182 B2
(45) Date of Patent: May 10, 2022

(54) METHOD FOR REMOVING REFRACTORY METAL CORES

(71) Applicant: United Technologies Corporation, Farmington, CT (US)

(72) Inventors: Daniel A. Bales, Avon, CT (US); Thomas DeMichael, Stafford Springs, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/816,865

(22) Filed: Mar. 12, 2020

(65) Prior Publication Data

US 2021/0283681 A1 Sep. 16, 2021

(51) Int. Cl.

| | |
|---|---|
| ***B22D 29/00*** | (2006.01) |
| ***F27B 5/14*** | (2006.01) |
| ***F27B 5/00*** | (2006.01) |
| ***F27B 5/02*** | (2006.01) |
| ***F27B 5/06*** | (2006.01) |

(52) U.S. Cl.

CPC ..... *B22D 29/002* (2013.01); *F27B 5/00* (2013.01); *F27B 5/02* (2013.01); *F27B 5/06* (2013.01); *F27B 5/14* (2013.01)

(58) Field of Classification Search

CPC . B22D 26/002; F27B 5/06; F27B 5/02; F27B 5/00; F27B 5/14

USPC ..... 266/171; 164/132; 134/2, 3, 22.11, 134/22.19, 22.14, 35, 42; 29/889.1; 416/92, 96 R

See application file for complete search history.

(56) References Cited

U.S. PATENT DOCUMENTS

| | | | | |
|---|---|---|---|---|
| 3,799,178 A * | 3/1974 | Anderson | B28B 7/386 | 134/58 R |
| 4,287,932 A * | 9/1981 | Schneider | B22C 7/02 | 164/132 |
| 5,014,763 A | 5/1991 | Frank | | |
| 5,507,306 A * | 4/1996 | Irvine | B08B 9/00 | 134/144 |
| 5,915,452 A * | 6/1999 | Conroy | B08B 3/022 | 164/345 |

(Continued)

FOREIGN PATENT DOCUMENTS

| | | |
|---|---|---|
| EP | 0969115 B1 | 1/2005 |
| WO | 9735678 A2 | 10/1997 |

OTHER PUBLICATIONS

European Search Report dated Jul. 6, 2021 issued for corresponding European Patent Application No. 21162194.1.

*Primary Examiner* — Jessee R Roe
*Assistant Examiner* — Michael Aboagye
(74) *Attorney, Agent, or Firm* — Bachman & LaPointe, P.C.

(57) ABSTRACT

A furnace for removing a molybdenum-alloy refractory metal core through sublimation comprising a retort furnace having an interior; a sublimation fixture insertable within the interior of the retort furnace, the sublimation fixture configured to receive at least one turbine blade having the molybdenum-alloy refractory metal core; a flow passage thermally coupled to the retort furnace configured to heat a fluid flowing through the flow passage and deliver the fluid to the molybdenum-alloy refractory metal core causing sublimation of the molybdenum-alloy refractory metal core.

11 Claims, 7 Drawing Sheets

(56) References Cited

U.S. PATENT DOCUMENTS

| | | | | |
|---|---|---|---|---|
| 6,474,348 | B1 * | 11/2002 | Beggs | B22D 29/006 134/22.1 |
| 7,270,170 | B2 | 9/2007 | Beals et al. | |
| 8,091,610 | B2 * | 1/2012 | Graham | B22D 29/002 164/132 |
| 9,808,862 | B2 * | 11/2017 | Verner | B22D 29/006 |
| 2021/0147665 | A1 * | 5/2021 | Reidy | B22F 10/10 |

* cited by examiner

METHOD FOR REMOVING REFRACTORY METAL CORES

BACKGROUND

The present disclosure is directed to the improved process of removing refractory metal core material, and more particularly use of production tooling for non-aqueous removal of refractory metal cores.

Cooled gas turbine airfoils are generally cast from nickel super alloys (e.g., IN100, Mar-M-200), or more advanced nickel alloys having improved creep strength at elevated temperature. Historically, cooled turbine airfoils utilize ceramic cores for creating the internal cooling configurations. More advanced cooling schemes utilize a combination of both ceramic cores and/or refractory metal cores. Ceramic core material is easily removed via autoclaving. Whereas refractory metal core removal up until now has required immersion within aggressive acids for significant lengths of time (e.g., hours/days). Such acids and duration can result in selective attack of the internal surfaces, sometimes resulting in cracking as a result of the retention of internal residual stresses from the casting process.

What is needed is an alternative, more environment/health and safety friendly process for removing molybdenum-alloy refractory metal cores without causing selective attack and/or cracking of the internal cooling passages.

SUMMARY

In accordance with the present disclosure, there is provided a furnace for removing a molybdenum-alloy refractory metal core through sublimation comprising a retort furnace having an interior; a sublimation fixture insertable within the interior of the retort furnace, the sublimation fixture being configured to receive at least one turbine blade having the molybdenum-alloy refractory metal core; a flow passage is thermally coupled to the retort furnace and configured to heat a fluid flowing through the flow passage and deliver the fluid to the molybdenum-alloy refractory metal core causing sublimation of the molybdenum-alloy refractory metal core.

A further embodiment of any of the foregoing embodiments may additionally and/or alternatively include the flow passage being fluidly coupled to a coupling configured to receive air, and the flow passage being fluidly coupled to a junction at an end opposite the coupling, the junction being configured to fluidly couple to the sublimation fixture.

A further embodiment of any of the foregoing embodiments may additionally and/or alternatively include the flow passage is formed within a wall of the retort furnace.

A further embodiment of any of the foregoing embodiments may additionally and/or alternatively include the sublimation fixture comprises a blade receiver fluidly coupled to the flow passage, the blade receiver being configured to receive a root of the turbine blade.

A further embodiment of any of the foregoing embodiments may additionally and/or alternatively include the furnace for removing a molybdenum-alloy refractory metal core through sublimation further comprising a collector fluidly coupled to the interior of the retort furnace, wherein the collector is configured to collect waste discharged from the blade responsive to sublimation of the molybdenum-alloy refractory metal core.

A further embodiment of any of the foregoing embodiments may additionally and/or alternatively include the furnace for removing a molybdenum-alloy refractory metal core through sublimation further comprising an inner furnace box within an outer furnace box of the retort furnace, the inner furnace box configured to receive the sublimation fixture.

A further embodiment of any of the foregoing embodiments may additionally and/or alternatively include the inner furnace box comprises an enclosure coupled to a base at a joint having a seal between a wall of the enclosure and the base.

In accordance with the present disclosure, there is provided a furnace for removing a molybdenum-alloy refractory metal core from a blade through sublimation comprising a retort furnace comprising an outer furnace box having an interior; an inner furnace box within the interior, the inner furnace box comprising an enclosure coupled to a base; a sublimation fixture insertable within the inner furnace box, the sublimation fixture configured to receive at least one turbine blade having the molybdenum-alloy refractory metal core; a flow passage coupled to the sublimation fixture; the flow passage thermally coupled to the retort furnace configured to heat a fluid flowing through the flow passage and deliver the fluid to the molybdenum-alloy refractory metal core causing sublimation of the molybdenum-alloy refractory metal core; and a collector fluidly coupled to the interior of the outer furnace box, wherein the collector is configured to collect waste discharged from the blade responsive to sublimation of the molybdenum-alloy refractory metal core.

A further embodiment of any of the foregoing embodiments may additionally and/or alternatively include the flow passage is fluidly coupled to a coupling configured to receive air, and the flow passage is fluidly coupled to a junction at an end opposite the coupling, the junction being configured to fluidly couple to the sublimation fixture.

A further embodiment of any of the foregoing embodiments may additionally and/or alternatively include the flow passage is formed within a wall of the inner furnace box.

A further embodiment of any of the foregoing embodiments may additionally and/or alternatively include the sublimation fixture comprises a blade receiver fluidly coupled to the flow passage, the blade receiver configured to receive a root of the turbine blade.

A further embodiment of any of the foregoing embodiments may additionally and/or alternatively include the enclosure is coupled to the base at a joint having a seal between a wall of the enclosure and the base.

A further embodiment of any of the foregoing embodiments may additionally and/or alternatively include the sublimation fixture comprises a cavity formed between internal plenums opposite the blade receiver.

In accordance with the present disclosure, there is provided a process for removing a molybdenum-alloy refractory metal core from a turbine blade through sublimation comprising installing at least one turbine blade in a sublimation fixture; installing the sublimation fixture in a retort furnace; removing a molybdenum-alloy refractory metal core from the at least one turbine blade through sublimation with air; and capturing waste discharged from the blade responsive to sublimation of the molybdenum-alloy refractory metal core responsive to the sublimation.

A further embodiment of any of the foregoing embodiments may additionally and/or alternatively include the process further comprising reusing the waste; and disposing of the waste.

A further embodiment of any of the foregoing embodiments may additionally and/or alternatively include the process further comprising prior to the step of installing at least one turbine blade in a sublimation fixture casting the at least one blade with a ceramic core and the molybdenum-alloy refractory metal core; and removing the ceramic core.

A further embodiment of any of the foregoing embodiments may additionally and/or alternatively include the process further comprising supplying air from an air source to a coupling fluidly coupled to the flow passage; heating the air flowing through the flow passage; supplying the air from the flow passage to a junction; and coupling the junction to the sublimation fixture.

A further embodiment of any of the foregoing embodiments may additionally and/or alternatively include the process further comprising flowing the air through the sublimation fixture into the at least one turbine blade; and flowing the air through the turbine blade; contacting the molybdenum-alloy refractory metal core with the air.

A further embodiment of any of the foregoing embodiments may additionally and/or alternatively include the air is heated to a temperature of from 1300 degrees Fahrenheit to 2000 degrees Fahrenheit.

A further embodiment of any of the foregoing embodiments may additionally and/or alternatively include the process step of installing the sublimation fixture in a retort furnace further comprising the retort furnace comprises an outer furnace box having an interior and an inner furnace box within the interior, the inner furnace box comprising an enclosure coupled to a base; and inserting the sublimation fixture within the inner furnace box.

Other details of the process and equipment are set forth in the following detailed description and the accompanying drawings wherein like reference numerals depict like elements.

DETAILED DESCRIPTION

Figure 1:
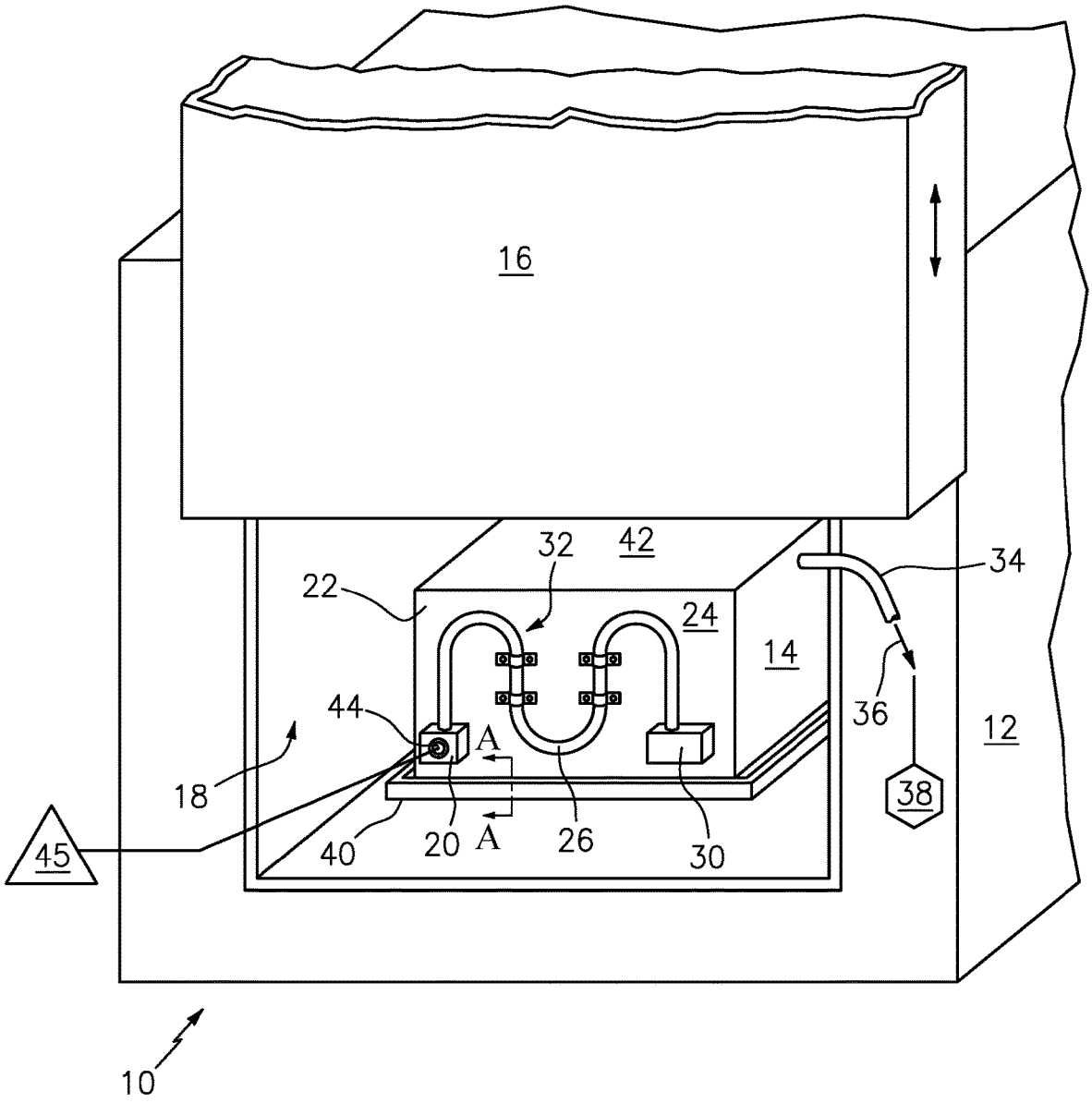
FIG. 1 is an isometric schematic diagram of an exemplary retort furnace.

Referring now to FIG. 1, there is illustrated an exemplary retort furnace 10. The retort furnace 10 includes an outer furnace box 12 containing an inner furnace box 14. The retort furnace 10 includes the inner furnace box 14 and outer furnace box 12 configured to operate with a batch process that includes accurate control of the atmosphere, as well as control the atmosphere within the retort furnace 10 due to the closed arrangement. The inner furnace box 14 can be constructed of any materials configured to operate at the temperatures and environment within the furnace 10, such as Haynes 230 alloy material. The outer furnace box 12 includes a furnace door 16 configured to slide open and close to isolate the atmosphere within an interior 18 of the outer furnace box 12.

The inner furnace box 14 situated within the interior 18 includes a coupling 20 attached to an exterior 22 of a retort furnace wall 24. A flow passage 26 is coupled to the coupling 20. The coupling 20 can include a quick connect 44 configured to receive an external air supply line from an air source 45. The flow passage 26 fluidly connects with an interior 28 of the inner furnace box 14 (See FIGS. 4, 5). A junction 30 can be fluidly coupled to the coupling 20 via the flow passage 26. Clamps 32 are shown fastening the flow passage 26 to the exterior 24. In an exemplary arrangement, the flow passage 26 can be formed as a tube. The flow passage tube 26, coupling 20 and junction 30 can be constructed of an Inconel 625 alloy. The flow passage 26 can be arranged in a serpentine pattern as shown. The serpentine pattern is arranged to maximize the heat transfer from the retort furnace 10 to the fluid 46 (air and the like) flowing through the flow passage 26. A discharge 34 is fluidly coupled to the inner furnace box 14. The discharge 34 is configured to flow process waste 36 out of the inner furnace box 14 to the interior 18. In an exemplary embodiment, the waste 36 can include molybdenum dioxide ($MoO_2$) and molybdenum trioxide ($MoO_3$) exhaust formed from the sublimation of the molybdenum-alloy refractory metal cores 48. The discharge 34 can be coupled to a collector 38. The inner furnace box 14 includes a base 40 supporting the retort furnace walls 24. The retort furnace walls 24 form an enclosure 42 that separates the atmosphere of the inner furnace box 14 from the atmosphere of the outer furnace box 12.

Figure 2:
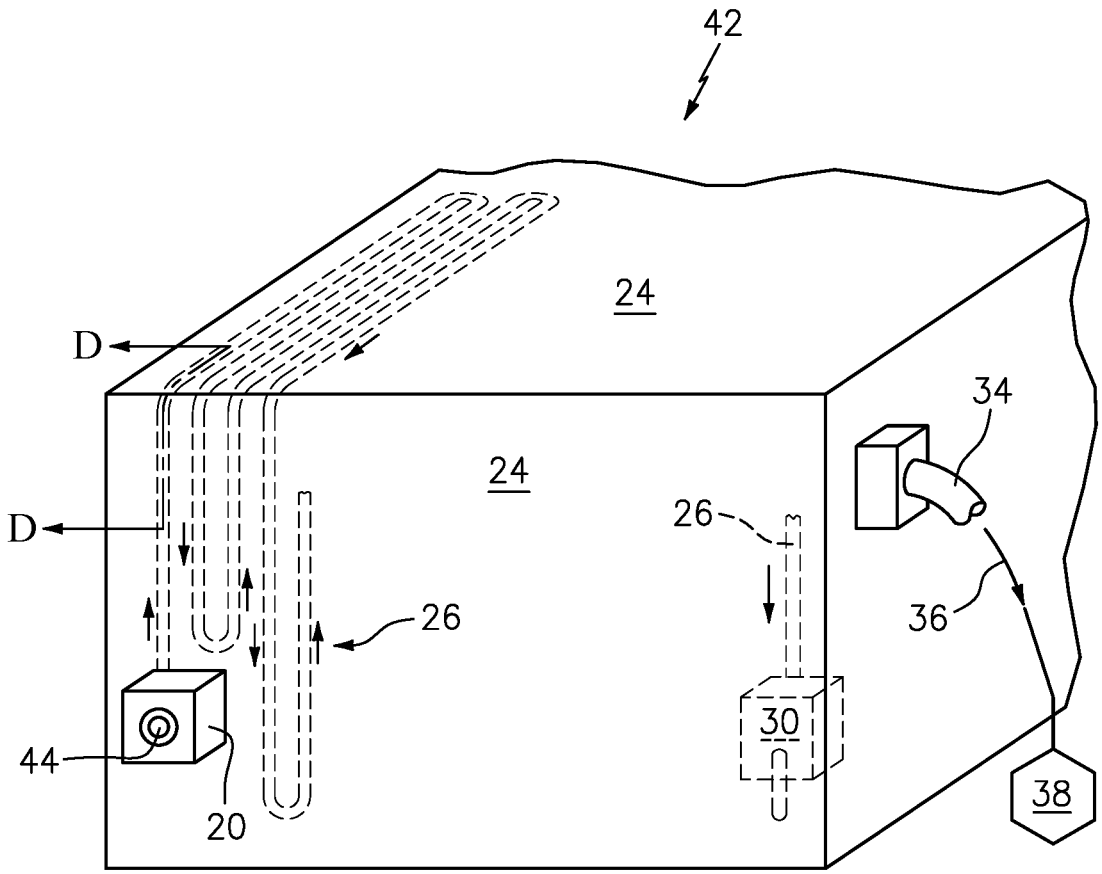
FIG. 2 is schematic isometric diagram of the exemplary inner retort furnace.
Figure 3:
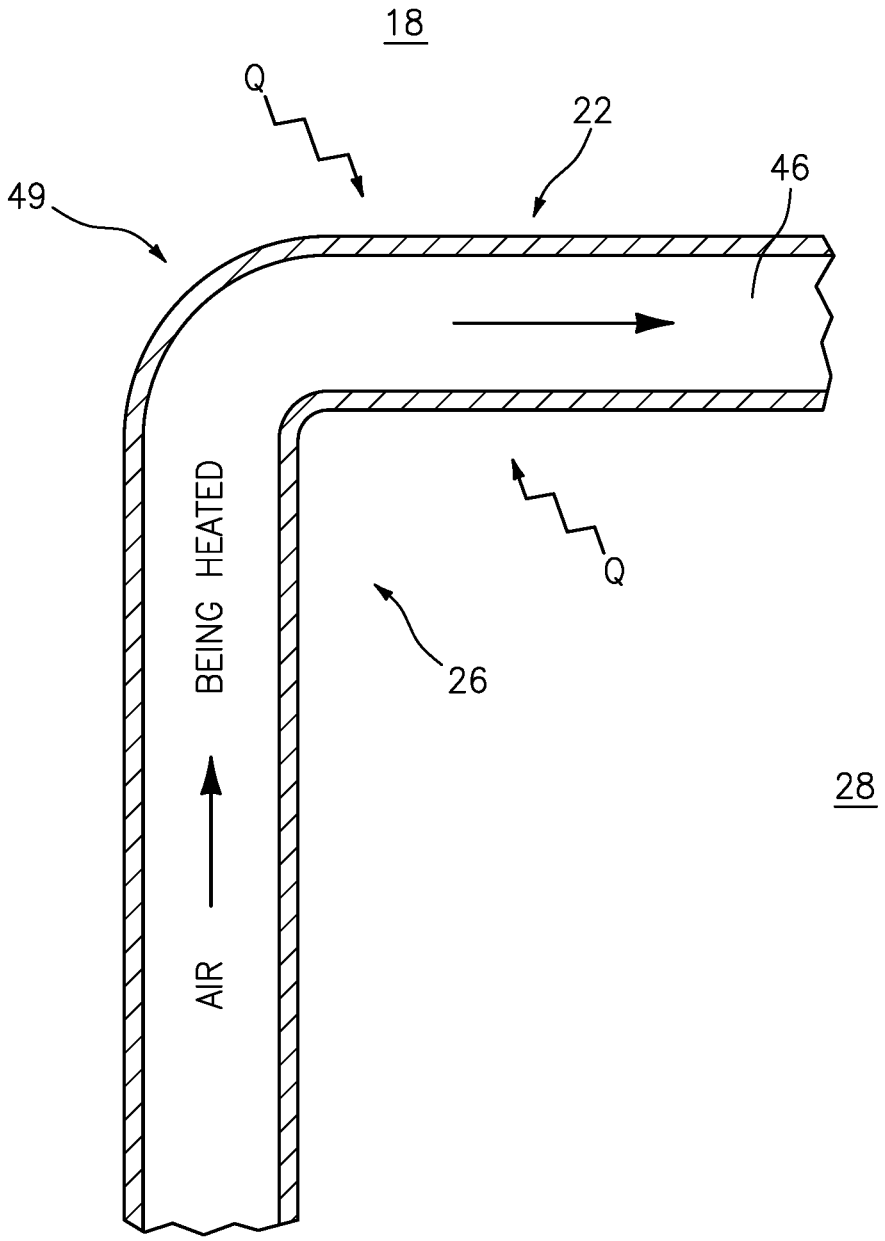
FIG. 3 is section D-D of an exemplary flow passage employed in the exemplary inner retort furnace.

Referring also, to FIG. 2 and FIG. 3, the enclosure 42 is shown with exemplary flow passages 26. The flow passages 26 are formed in the retort furnace wall 24 of the enclosure 42. The flow passage 26 can be formed from similar material to the enclosure 42, such as Inconel 625 alloy or a Haynes 230 alloy. The fluid 46 that flows through the flow passage 26 can be air. The air 46 is used to sublimate the molybdenum-alloy refractory metal cores 48. Thermal energy Q is transferred to the air 46 to provide the proper air temperature in order to sublimate the molybdenum-alloy refractory metal cores 48, above 700 degrees Centigrade (>1300 F). In exemplary embodiments, the flow passage 26 can include smooth radius transitions at the top and vertical corners 49. The flow passage 26 can be between the exterior 22 of the wall 24 and the interior 28 of the inner box 14.

Figure 4:
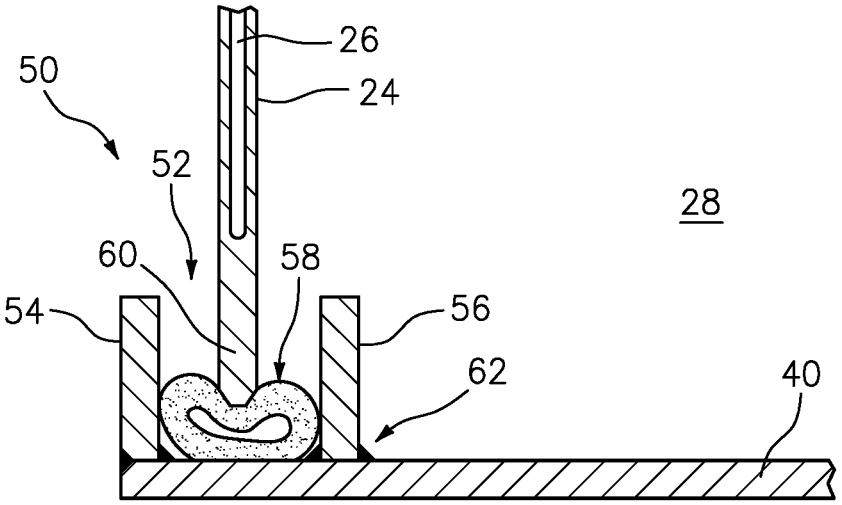
FIG. 4 is a section A-A from FIG. 1 of the exemplary inner retort furnace wall to base joint.

Referring also to FIG. 4 the section A-A of FIG. 1 illustrates the wall 24 to base 40 joint 50. The joint 50 includes a slot 52 formed between a first support 54 and second support 56 attached to the base 40. In an exemplary embodiment, the slot 52, first support 54 and second support 56 can be rectilinear. The wall 24 nests in the slot 52 and abuts a seal 58 at an edge 60 of the wall 24. The seal 58 can comprise a woven ceramic hose. Welds 62 can attach the supports 54, 56 to the base 40.

Figure 5:
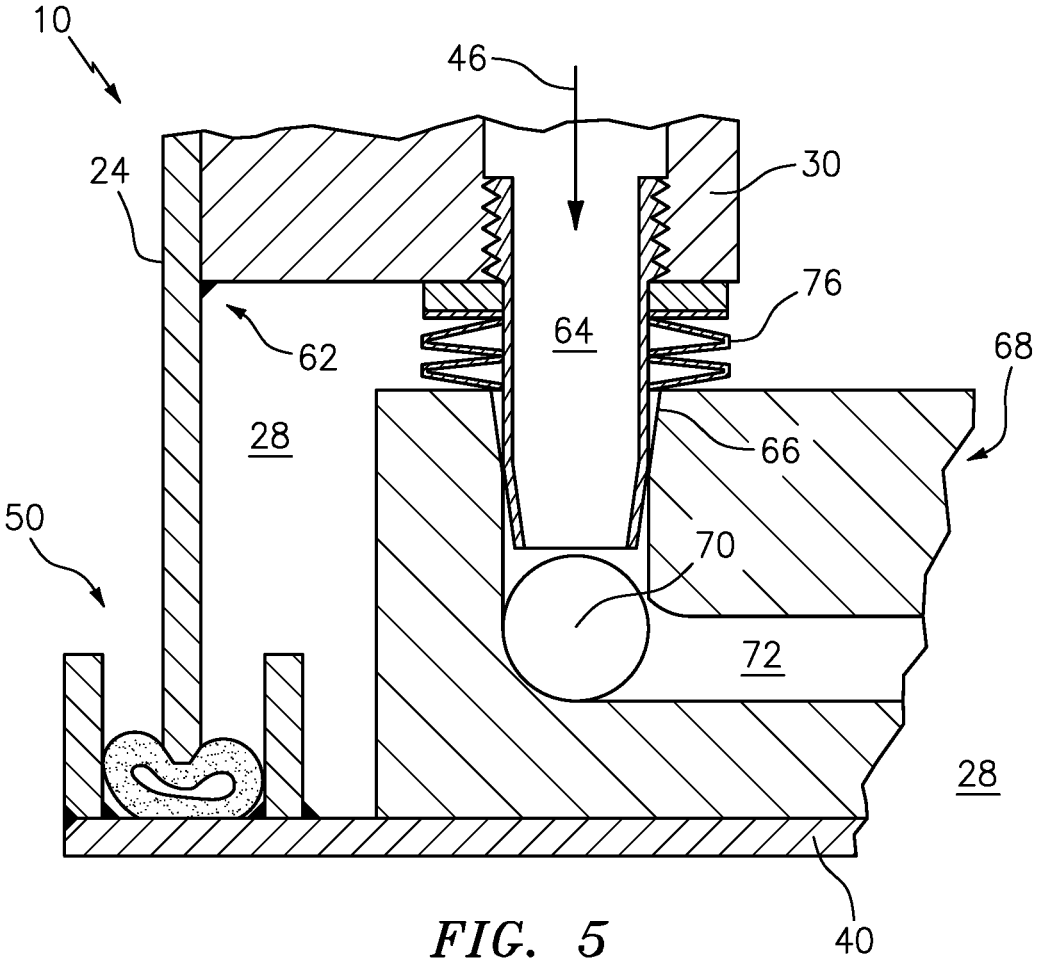
FIG. 5 is a section B-B from FIG. 6 of the exemplary sublimation fixture installed in the retort furnace.

Referring also to FIG. 5, the details of the exemplary retort furnace 10 are shown. The junction 30 is shown coupled to the wall 24. A weld 62 can attach the junction 30 to the wall 24 at the interior of the inner furnace box 14. The junction 30 includes an adaptor 64 that extends into an aperture 66 of a sublimation fixture 68 installed within the interior 28 of the inner furnace box 14. The air 46 can be directed from the adaptor 64 into the aperture 66 and flow into a main passageway 70 of the sublimation fixture 68. The main passageway 70 feeds the air 46 into a plurality of internal plenum legs 72 that direct the air 46 to blades 74. A bellows seal 76 can be utilized to seal between the junction 30 and the sublimation fixture 68.

Figure 6:
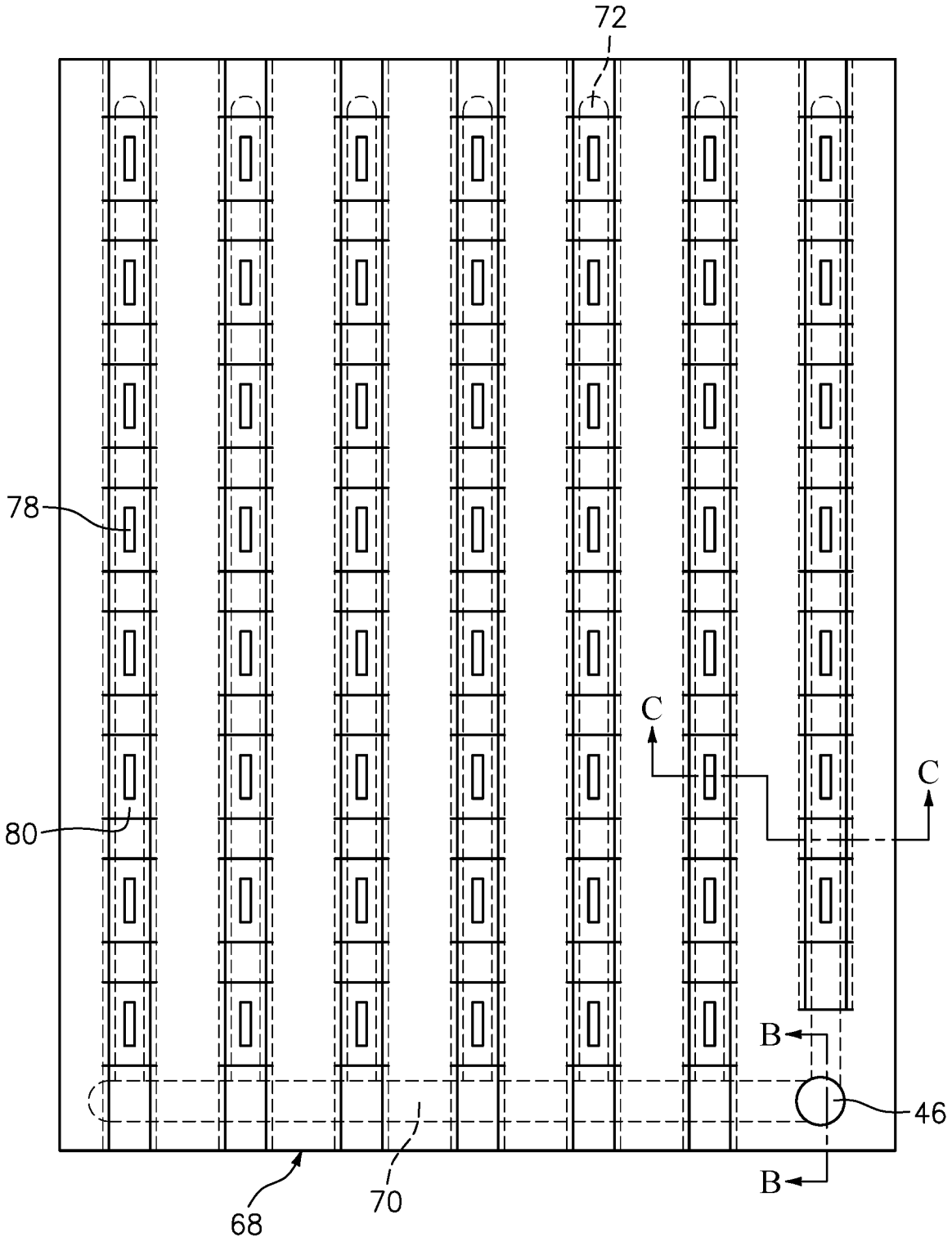
FIG. 6 is a plan view of an exemplary sublimation fixture.

Referring also to FIG. 6 a top view of the exemplary sublimation fixture 68 is shown. The sublimation fixture 68 is insertable into the interior 28 of the inner furnace box 14. The sublimation fixture 68 includes the main passageway 70 that feeds the internal plenum legs 72 allowing the air 46 to flow into each slot 78 and into each blade 74 inserted into each blade receiver 80. The air 46 can flow through the blade 74 to contact the molybdenum RMC 48. The sublimation fixture 68 can be configured with any number of blade receivers 80. In an exemplary embodiment, the sublimation fixture 68 can comprise 55 blade receivers 80. In an exemplary embodiment the sublimation fixture 68 can have dimensions of 17 inches wide×19 inches long×2.25 inches high. The sublimation fixture 68 can be manufactured by use of additive manufacturing or casting techniques utilizing Haynes 230 nickel alloy or Inconel 625 nickel alloy materials. These materials provide the necessary yield strength and oxidation resistance for the operational conditions of the sublimation fixture 68.

Figure 7:
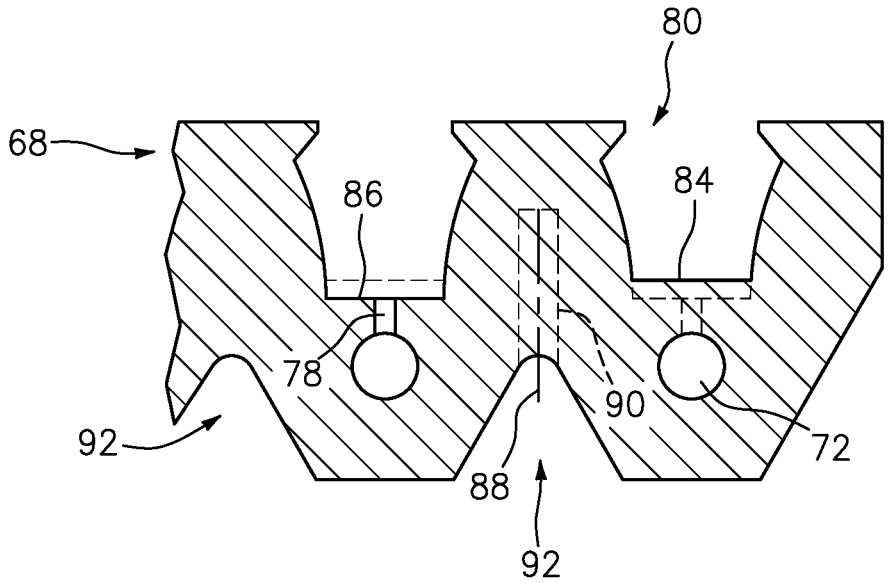
FIG. 7 is a section C-C from FIG. 6 of the exemplary sublimation fixture.
Figure 8:
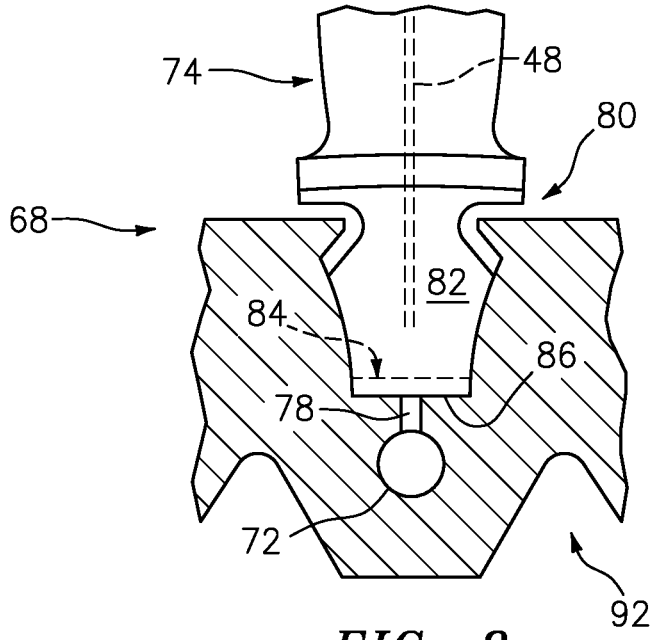
FIG. 8 is a section view of a portion of the exemplary sublimation fixture with a blade.

Referring also to FIG. 7 and FIG. 8, cross section views of the sublimation fixture 68. The blade receiver 80 has a cross section that closely matches the cross section of the as-cast blade root 82 of the turbine blade 74. The blade receiver 80 can have a slightly oversized vertical profile for accommodation of vertical movement and horizontal translation of blades 74 upon insertion into the blade receiver 80. The blade receiver 80 can have a floor 84. The blade receiver 80 can include a pocket 86 configured to position the blade 74.

The sublimation fixture 68 can include a thermocouple 88 seated in a thermocouple well 90. The thermocouples 88 can be placed strategically along the sublimation fixture 68 to provide for temperature data to operate the retort furnace 10.

The profile of the sublimation fixture 68 includes a cavity 92 formed opposite the blade receiver 80. The cavity 92 can be formed as a linear V with radius configuration that runs between the internal plenum legs 72. The cavity 92 serves a dual purpose. The first purpose of the cavity 92 is to reduce the overall weight of the sublimation fixture 68. The second purpose is to enlarge the surface area of the sublimation fixture 68 to improve the heat transfer from the inner furnace box 14 to the sublimation fixture 68. The air 46 flowing through the sublimation fixture 68 receives the thermal energy transferred from the inner furnace box 14 to the sublimation fixture 68. The sublimation fixture 68 having these features allows for shortened processing time for each set of turbine blades 74 mounted in the sublimation fixture 68 because the sublimation fixture 68 heats up faster, cools down faster, maintains more uniform temperature during the core removal operation process cycle, and maintains improved temperature uniformity during heating and cooling.

The collector 38 is configured to capture the waste 36 in the air 46 discharged from the sublimation of the molybdenum-alloy refractory metal cores 48. The hot air 46 flowing into and through the blades 74 passes over the molybdenum-alloy refractory metal cores 48 and sublimates the material. The air 46 discharges from the blade 74 into the interior 28 and flows to the collector 38. The waste 36 of molybdenum dioxide, and/or molybdenum trioxide in the waste 36 stream can be exhausted from the discharge 34 into the collector 38. The collector 38 can include a HEPA filtering system. The collector 38 can include a water entrainment tank configured to capture the molybdenum dioxide, and/or molybdenum trioxide. The molybdenum dioxide, and/or molybdenum trioxide can be reverted or disposed.

Figure 9:
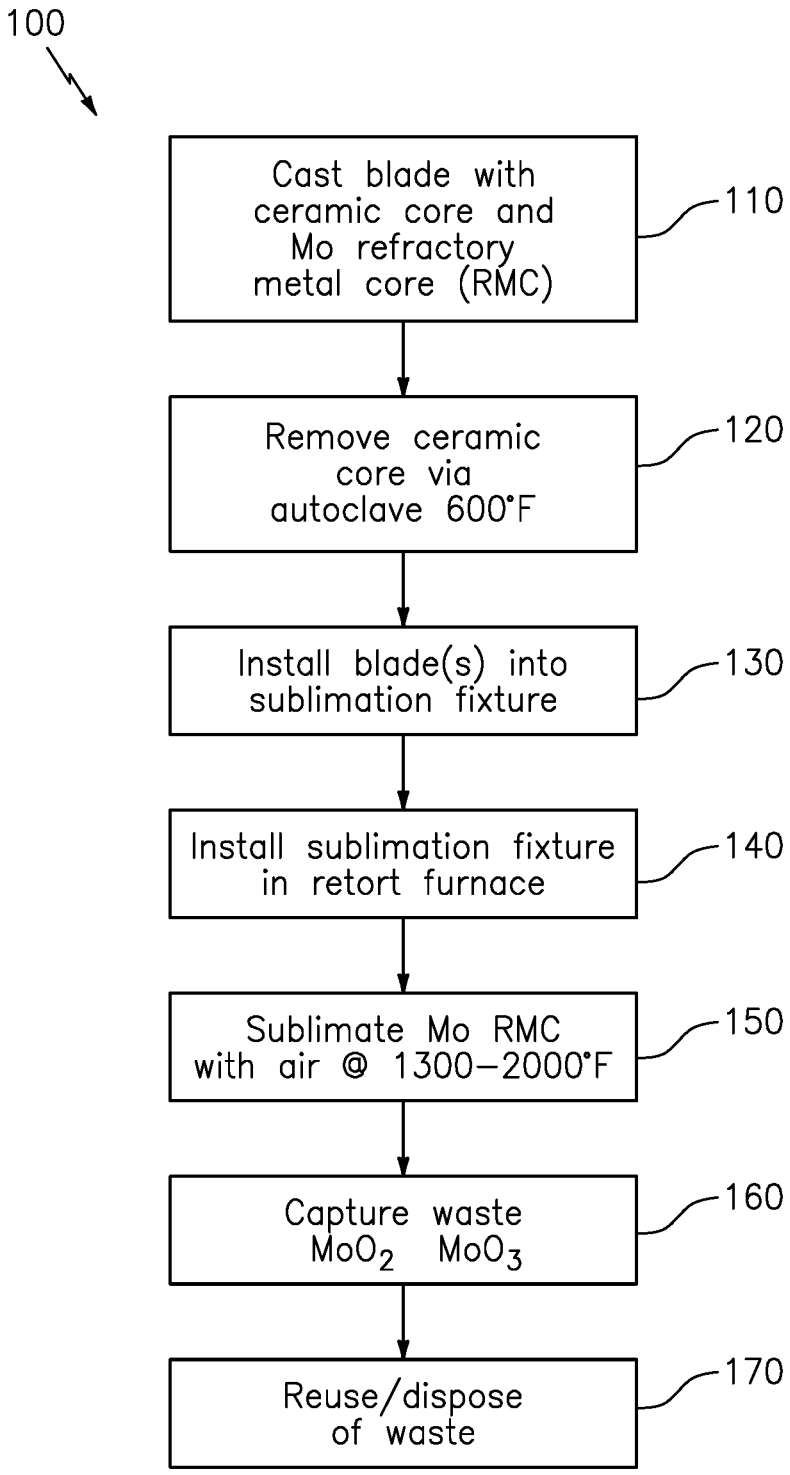
FIG. 9 is a process flow map of an exemplary process.

Referring also to FIG. 9 a process flow map of an exemplary process 100 is shown. A gas turbine engine blade 74 is cast including a ceramic core and molybdenum-alloy refractory metal cores 48, at step 110. The ceramic core is removed from the cast blade(s) 74 by using an autoclave at temperatures of about 600 degrees Fahrenheit, at step 120. The blade(s) 74 are loaded into the sublimation fixture 68, at step 130. The sublimation fixture 68 is loaded into the retort furnace 10, at step 140. At step 150, air 46 is coupled to the coupling 20 and forced through the passages 26 into the sublimation fixture 68 being heated to temperatures of between 1300 degrees and 2000 degrees Fahrenheit. The air 46 flows through the main passageway 70 and internal plenums 72 through the slots 78 into each blade 74 and through the individual cooling flow passages of the blade 74 contacting the molybdenum-alloy refractory metal cores 48 causing the molybdenum-alloy refractory metal cores 48 to sublimate. The air 46 containing waste 36 of $MoO_2$ and $MoO_3$ passes through the discharge 34 into the collector 38, at step 160. The waste 36 is then disposed of or reused, at step 170.

There has been provided a process and tooling for non-aqueous removal of refractory metal cores. While the tooling for non-aqueous removal of refractory metal cores has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A furnace for removing a molybdenum-alloy refractory metal core through sublimation comprising:

a retort furnace having an interior;

a sublimation fixture insertable within said interior of the retort furnace, said sublimation fixture configured to receive at least one turbine blade having the molybdenum-alloy refractory metal core;

a flow passage thermally coupled to said retort furnace configured to heat a fluid flowing through said flow passage and deliver said fluid to said molybdenum-alloy refractory metal core causing sublimation of said molybdenum-alloy refractory metal core, wherein said flow passage is fluidly coupled to a coupling configured to receive air, and said flow passage is fluidly coupled to a junction at an end opposite said coupling, said junction being configured to fluidly couple to said sublimation fixture.

2. The furnace for removing a molybdenum-alloy refractory metal core through sublimation according to claim 1, wherein said flow passage is formed within a wall of the retort furnace.

3. The furnace for removing a molybdenum-alloy refractory metal core through sublimation according to claim 1, wherein said sublimation fixture comprises a blade receiver fluidly coupled to said flow passage, said blade receiver configured to receive a root of said turbine blade.

4. The furnace for removing a molybdenum-alloy refractory metal core through sublimation according to claim 1, further comprising:

a collector fluidly coupled to said interior of the retort furnace, wherein said collector is configured to collect waste discharged from the blade responsive to sublimation of said molybdenum-alloy refractory metal core.

5. The furnace for removing a molybdenum-alloy refractory metal core through sublimation according to claim 1, further comprising:

an inner furnace box within an outer furnace box of said retort furnace, said inner furnace box configured to receive said sublimation fixture.

6. The furnace for removing a molybdenum-alloy refractory metal core through sublimation according to claim 1, wherein said inner furnace box comprises an enclosure coupled to a base at a joint having a seal between a wall of said enclosure and said base.

7. A furnace for removing a molybdenum-alloy refractory metal core from a blade through sublimation comprising:

a retort furnace comprising an outer furnace box having an interior;

an inner furnace box within said interior, said inner furnace box comprising an enclosure coupled to a base;

a sublimation fixture insertable within said inner furnace box, said sublimation fixture configured to receive at least one turbine blade having the molybdenum-alloy refractory metal core;

a flow passage coupled to said sublimation fixture; said flow passage thermally coupled to said retort furnace configured to heat a fluid flowing through said flow passage and deliver said fluid to said molybdenum-alloy refractory metal core causing sublimation of said molybdenum-alloy refractory metal core, wherein said flow passage is fluidly coupled to a coupling configured to receive air, and said flow passage is fluidly coupled to a junction at an end opposite said coupling, said junction being configured to fluidly couple to said sublimation fixture; and a collector fluidly coupled to said interior of the outer furnace box, wherein said collector is configured to collect waste discharged from the blade responsive to sublimation of said molybdenum-alloy refractory metal core.

8. The furnace for removing a molybdenum-alloy refractory metal core through sublimation according to claim 7, wherein said flow passage is formed within a wall of the inner furnace box.

9. The furnace for removing a molybdenum-alloy refractory metal core through sublimation according to claim 7, wherein said sublimation fixture comprises a blade receiver fluidly coupled to said flow passage, said blade receiver configured to receive a root of said turbine blade.

10. The furnace for removing a molybdenum-alloy refractory metal core through sublimation according to claim 7, wherein said enclosure is coupled to the base at a joint having a seal between a wall of said enclosure and said base.

11. The furnace for removing a molybdenum-alloy refractory metal core through sublimation according to claim 7, wherein said sublimation fixture comprises a cavity formed between internal plenums opposite said blade receiver.

* * * * *